US007021683B2

(12) United States Patent
Nissen

(10) Patent No.: US 7,021,683 B2
(45) Date of Patent: Apr. 4, 2006

(54) SLIDABLE DOOR LOCK BRACE

(76) Inventor: Gary W. Nissen, 9634 - 108th Ave. N., Largo, FL (US) 33773

( * ) Notice: Subject to any disclaimer, the term of this patent is extended or adjusted under 35 U.S.C. 154(b) by 104 days.

(21) Appl. No.: 10/877,148

(22) Filed: Jun. 25, 2004

(65) Prior Publication Data

US 2006/0006679 A1 Jan. 12, 2006

(51) Int. Cl.
*E05C 17/54* (2006.01)

(52) U.S. Cl. ..... 292/339; 70/94

(58) Field of Classification Search ..... 292/338, 292/339, 342, 343; 70/93, 94
See application file for complete search history.

(56) References Cited

U.S. PATENT DOCUMENTS

| | | | | |
|---|---|---|---|---|
| 840,486 | A | | 1/1907 | Fuchs |
| 843,527 | A | | 2/1907 | Fuchs |
| 977,182 | A | | 11/1910 | Fuchs |
| 1,847,705 | A | | 3/1932 | Yorger |
| 4,019,765 | A | | 4/1977 | Nichola |
| 4,213,315 | A | * | 7/1980 | Lewis ..... 70/94 |
| 4,438,640 | A | | 3/1984 | Willis |
| 4,607,870 | A | | 8/1986 | Crisp, Jr. et al. |
| 4,822,086 | A | | 4/1989 | Brown |
| 5,135,273 | A | | 8/1992 | MacCalder |
| 5,618,072 | A | * | 4/1997 | Pitchford ..... 292/339 |
| 5,983,680 | A | * | 11/1999 | Del Nin ..... 70/93 |

* cited by examiner

*Primary Examiner*—Gary Estremsky
(74) *Attorney, Agent, or Firm*—Larson & Larson, PA; Herbert W. Larson

(57) ABSTRACT

A standard door lock is connected through a bore in a door to a lock brace mechanism mounted on a fixed vertical plate on an inside surface of the door. A slide bar moves within a vertical slot in the fixed plate. Gearing within the brace mechanism turns a threaded rod at a 4:1 ratio to move a middle housing threaded to the rod in a downward direction to deploy a brace leg outwardly. By turning the brace mechanism in a reverse direction the brace leg is retracted to a position abutting the inside surface of the door.

15 Claims, 11 Drawing Sheets

SLIDABLE DOOR LOCK BRACE

BACKGROUND OF THE INVENTION

The invention relates to a spring activated leg brace for preventing forceable entry through a door. More particularly, it refers to a spring activated leg brace with a proximal end mounted on a housing movable along a threaded rod. A distal end of the leg brace descends to engage a floor area in a locked position, but is retracted to a position abutting an inner surface of a door when not in use.

Door braces employing a movable brace are well known in the prior art as seen in U.S. Pat. Nos. 840,486; 843,527; 977;182 and 1,847,705. These braces get in the way of a legal entrant and need to be stored when not in use. An effective door brace is needed that does not impede entry of a legal entrant and is not a storage problem.

SUMMARY OF THE INVENTION

The present invention solves the above problems by providing a spring activated leg brace having a proximal end mounted on a housing movable along a threaded rod. In the unlocked status, the brace is tightly held in a vertical position against the inner surface of the door. In the locked status, the brace slides downwardly and extends outwardly so that the distal end of the brace engages a floor surface to provide support for the door against a forceable break-in.

A standard door lock is connected to a cam and gears in a first brace housing. The cam and gears turn when a key is turned in the door lock. The cam causes a slide bar within a mounting plate to move downwardly and the gears turn the vertical rod threaded to a second brace housing. The second brace housing is connected to a top end of a brace so that downward movement of the second brace housing causes the brace to extend outwardly into a deployed position.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
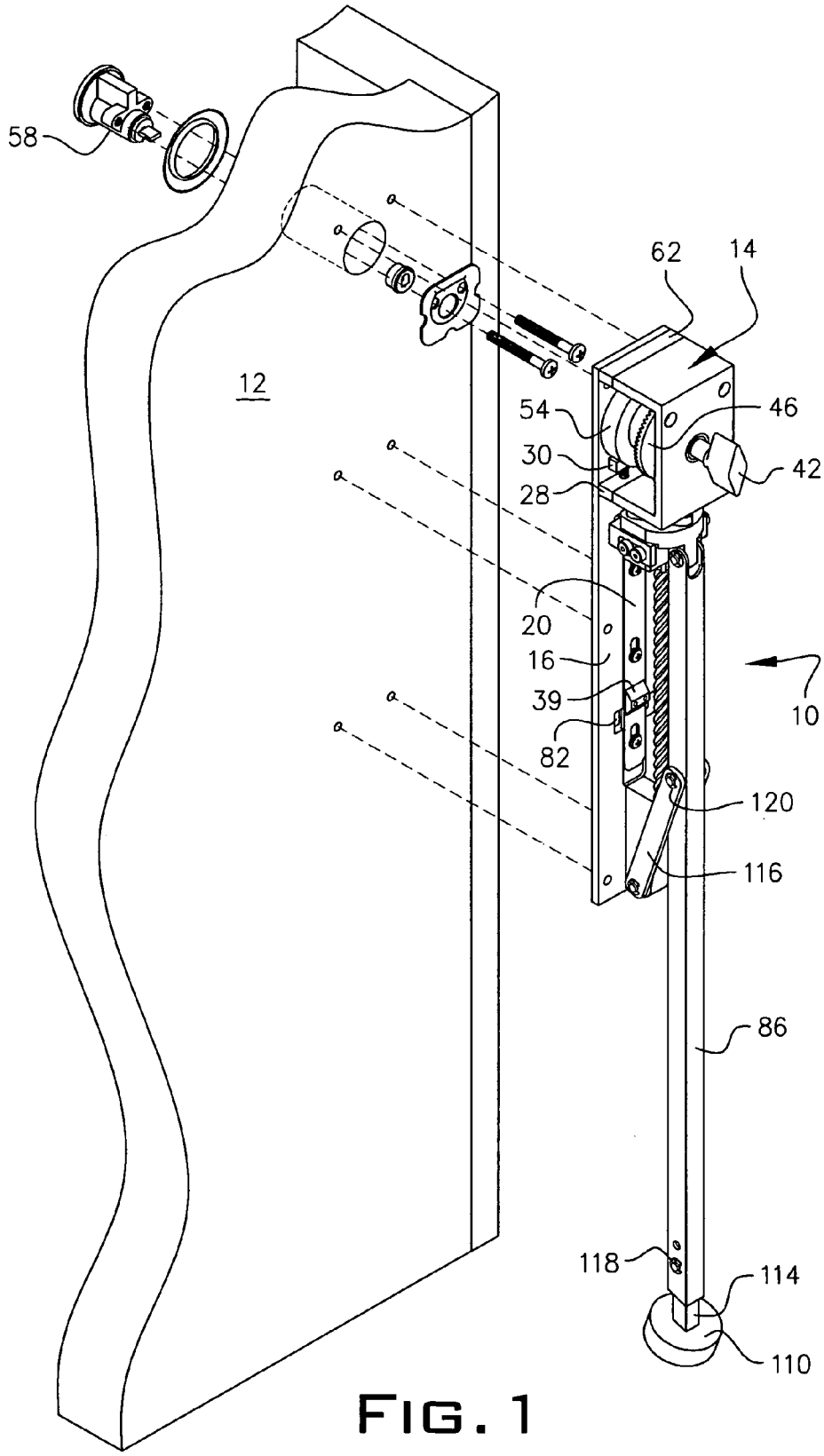
FIG. 1 is an exploded view of the door lock brace of this invention connected to a standard door lock.

Throughout the following detailed description, the same reference numerals refer to the same elements in all figures.

Figure 2:
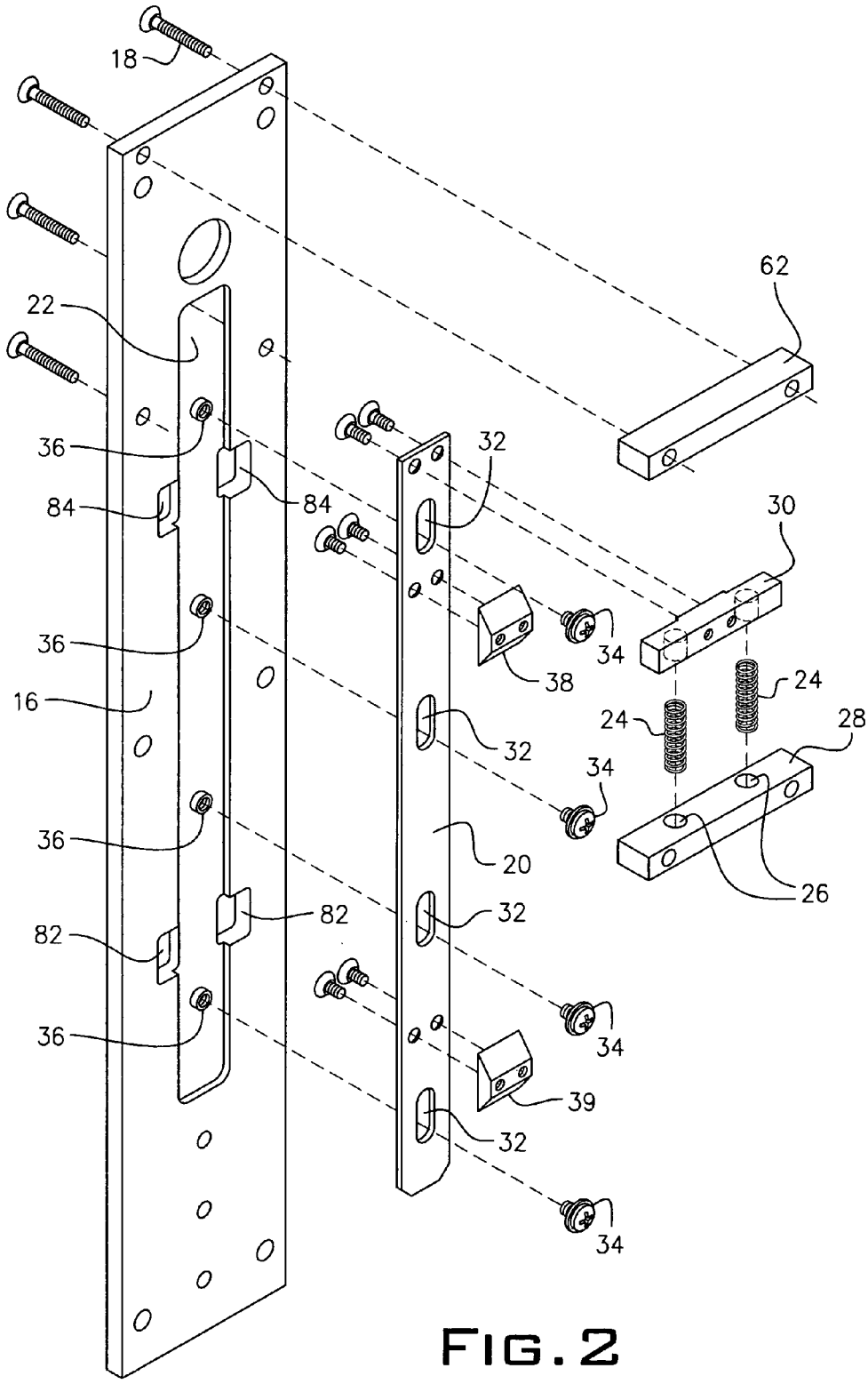
FIG. 2 is an exploded view of the door mount plate and slide bar.

Referring to FIG. 1, the slidable door lock brace 10 of this invention is mounted on an inside surface 12 of a door which is desired to be protected from a forced entry. The door lock brace 10 has a latch mechanism 14 mounted on a fixed vertical plate 16 shown in detail in FIG. 2. Plate 16 is bolted with bolts 18 to door surface 12. A slide bar 20 moves vertically downwardly within slot 22 in fixed plate 16 by downward pressure from springs 24 seated in openings 26 in spacer bar 28. Springs 24 are pressed downwardly by cam follower 30.

Slide bar 20 has a top, bottom and two middle openings 32 vertically spaced apart. A set screw 34 is inserted into each opening 32 and is screwed into threaded seats 36 in the fixed vertical plate 16. Additionally, stop 38 is attached to slide bar 20 below the top opening 32 and stop 39 is attached above the bottom opening 32.

Figure 3:
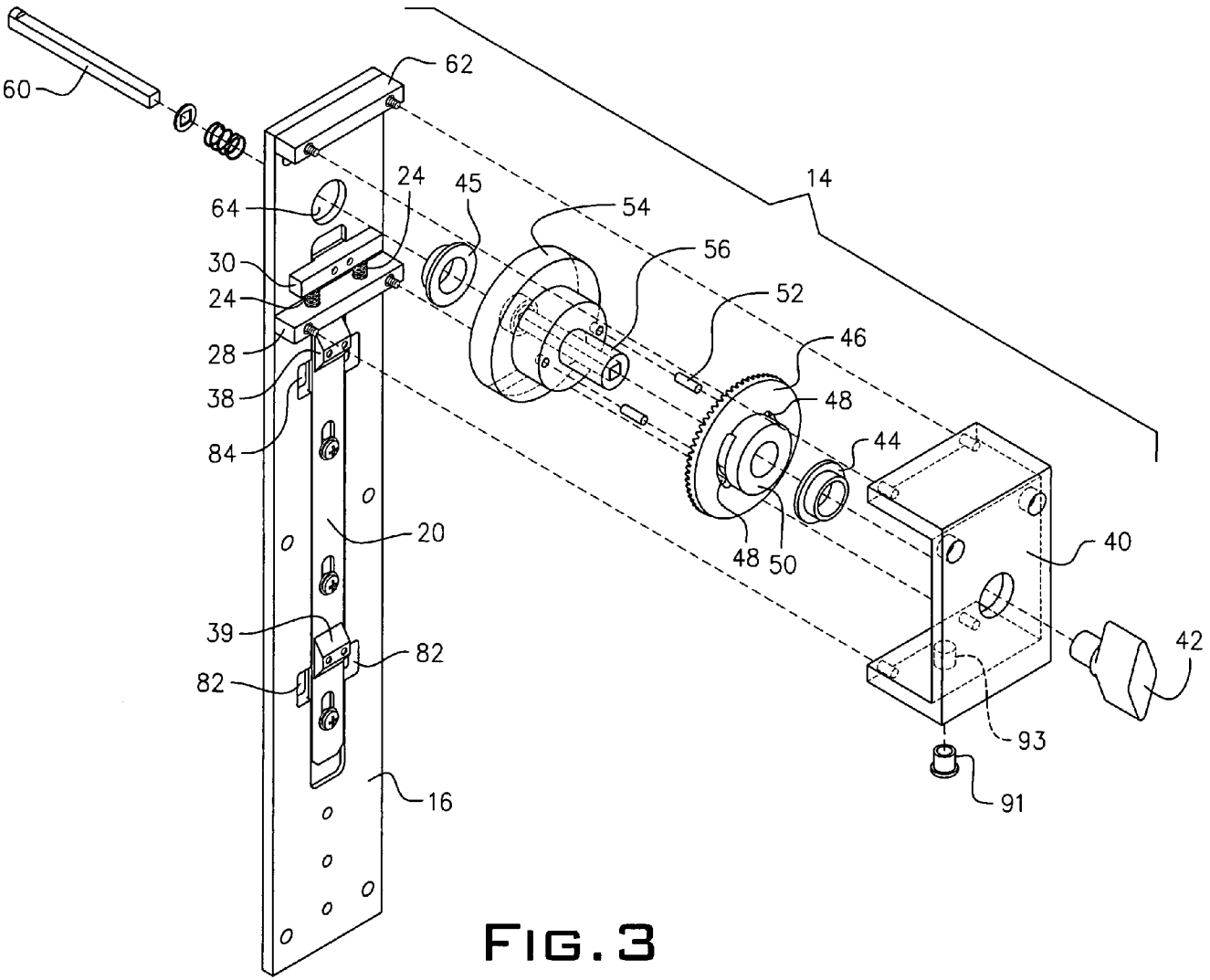
FIG. 3 is an exploded view of the upper latch mechanism enclosed within an upper housing.

Referring to FIG. 3, the latch mechanism 14 has a housing 40, a handle 42, a spacer 44, a gear 46 with oppositely positioned slots 48 on the gear axle 50. Pins 52 in slots 48 prevent rotation of gear 46 more than 90 degrees in either direction. Cam 54 engages the cam follower 30 as it turns to depress springs 24. Cam 54 turns with integral shaft 56 by turning handle 42 or when outside lock 58 turns key 60. An upper spacer bar 62 offsets housing 40 from fixed plate 16. An opening 64 in fixed plate 16 permits entry of key shaft 60 into axle 56. Spacer 45 offsets cam 54 from plate 16. Screws 18 attach the housing 40 to spacer bars 62 and 28 respectively, as well as to the fixed plate 16.

Figure 4:
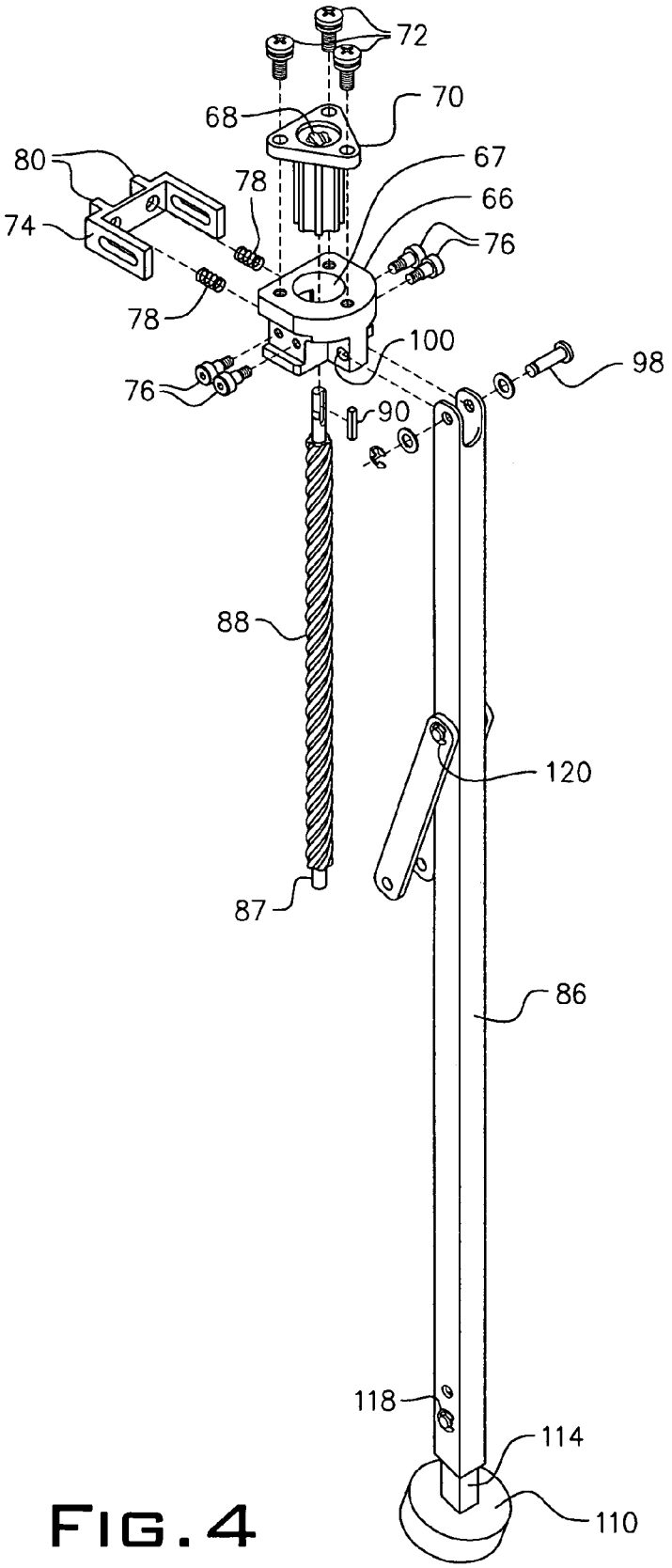
FIG. 4 is an exploded view of the middle lock housing enclosing a threaded rod and the upper end connection to the brace.
Figure 5:
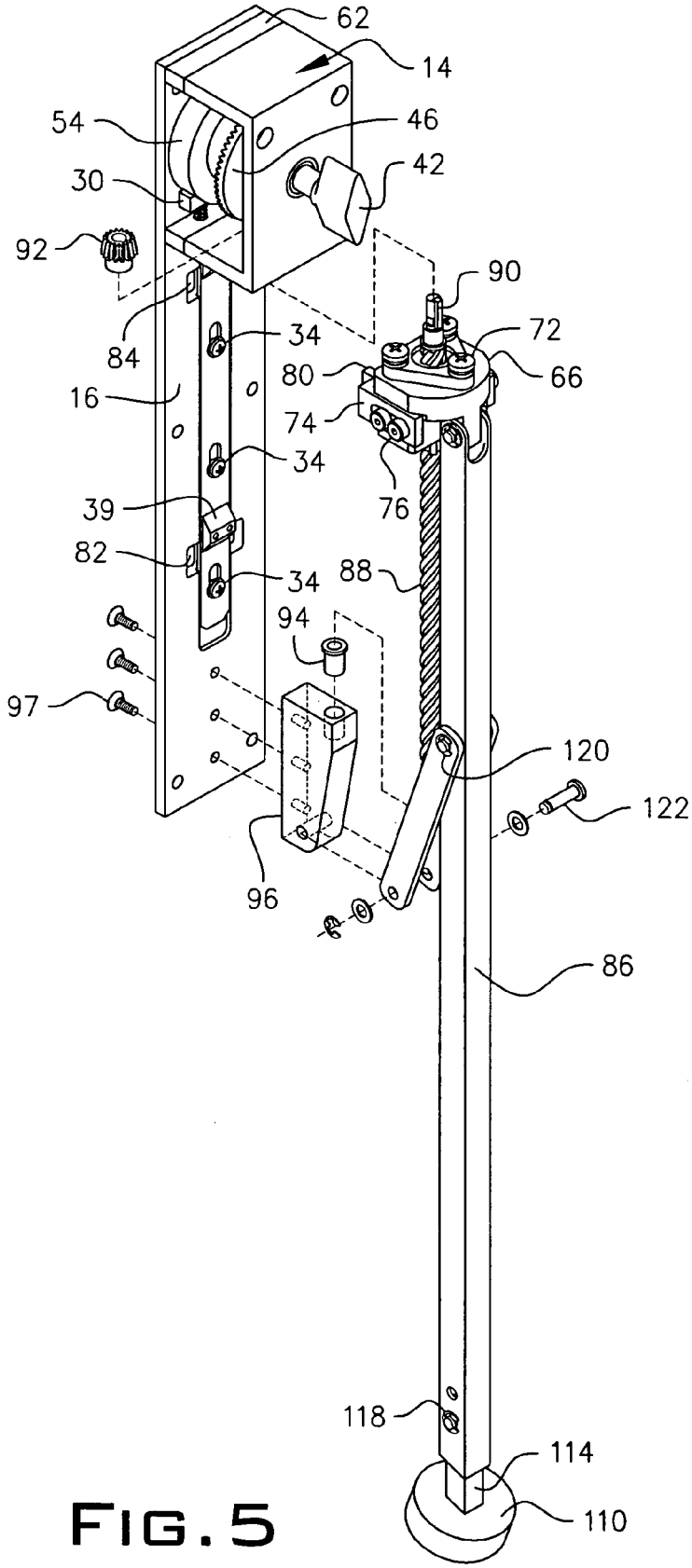
FIG. 5 is an exploded view of the brace and threaded rod connection to the bottom housing.

Referring to FIGS. 4 and 5, a middle housing 66 has a central opening 67 in which an internally threaded lug 70 is seated. Lug 70 is attached to middle housing 66 by screws 72 and has a central annular opening 68. A U-shaped lock clamp 74 is attached to housing 66 by screws 76. Springs 78 press feet 80 extending away from clamp 74 into lower engagement holes 82 or upper engagement holes 84 in the fixed plate 16. Lower engagement holes 82 are engaged by feet 80 when the brace leg 86 is fully deployed and upper engagement holes 84 are engaged by feet 80 when brace leg 84 is in the stored mode. Threaded rod 88 is threaded through lug 70 and has a top key 90 attached to gear 92. Top key 90 passes through hole 93 in housing 40 with spacer 91 between key 90 and gear 92. A bottom projection 87 from threaded rod 88 inserts via a spacer 94 into a bottom housing 96. The bottom housing 96 is attached to a lower portion of fixed plate 16 by screws 97. The gear ratio between gear 46 and the threaded rod is about 4:1.

Figure 6:
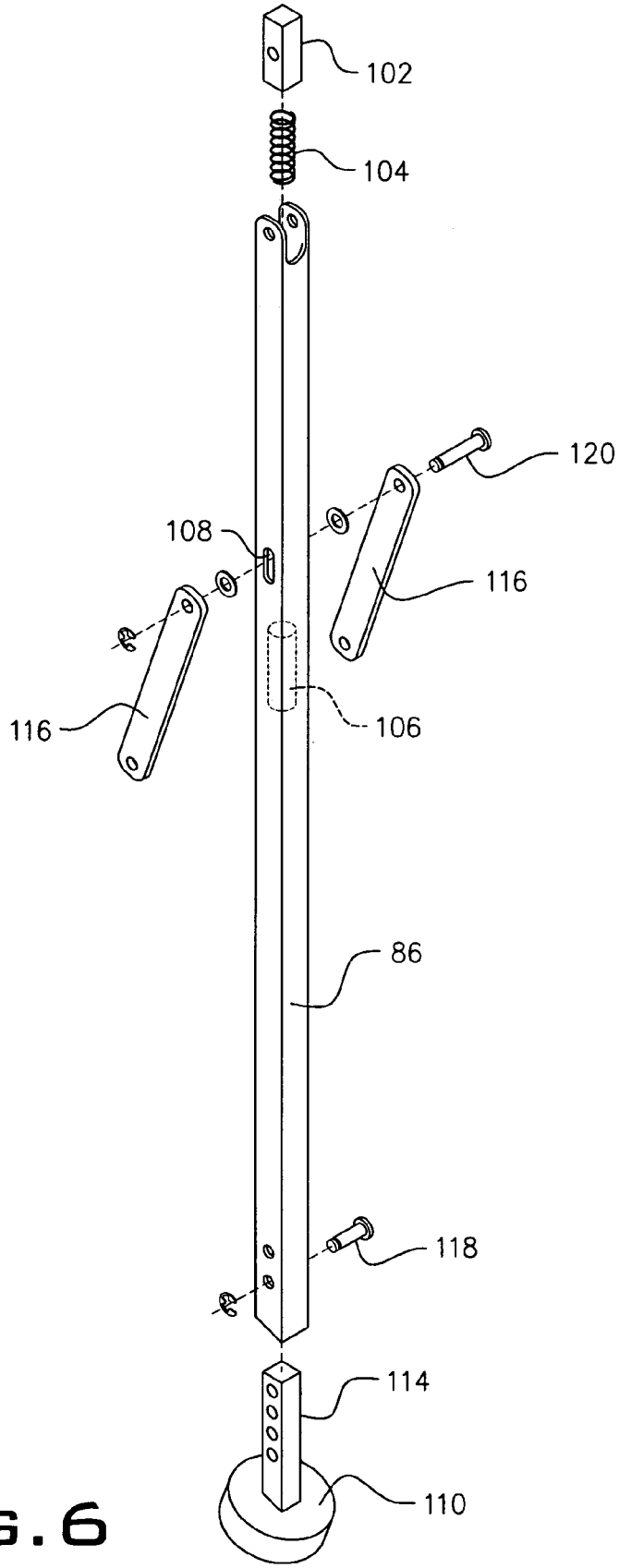
FIG. 6 is an exploded view of the brace.
Figure 7:
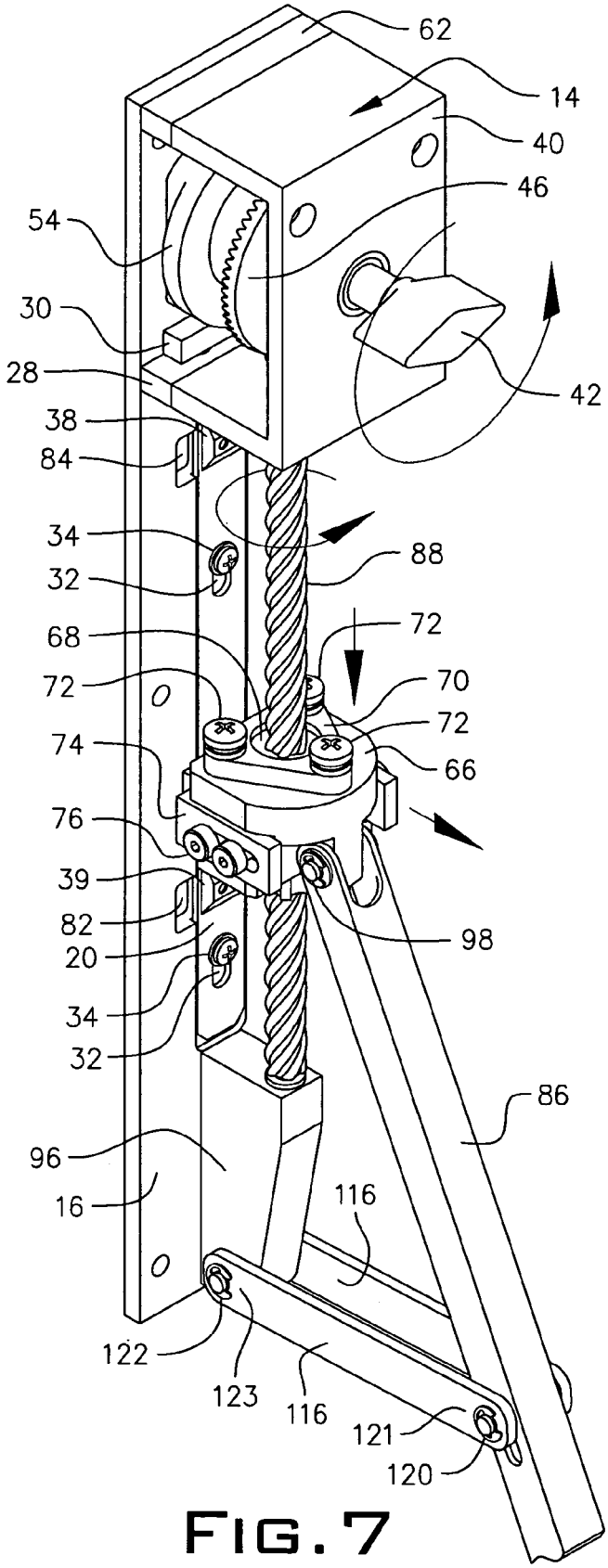
FIG. 7 is a perspective view of the door lock brace during deployment.

An upper end of the brace leg 86 is attached by a C-clip and pin 98 to an axial bore 100 in middle housing 66. As seen in FIG. 6, the brace leg 86 has a first wedge 102 and spring 104 that sit on a second wedge 106 inside slot 108 in leg brace 86 about one third of the way down from the attachment to the middle housing 66. Pin 120 passes through an axial hole in wedge 102. The bottom of the leg brace 86 has a pad 110 and rod 114 fitted within leg brace 86 and held in place by a C-clip and pin 118. A pair of side hinges 116 connect the leg brace 86 to the bottom housing 96 as shown in FIG. 7. A C-clip and pin 120 connects a first end 121 of the side hinges 116 to the leg brace 86 and the second end 123 of the side hinge 116 to the bottom housing 96 with a C-clip and pin 122.

Figure 9:
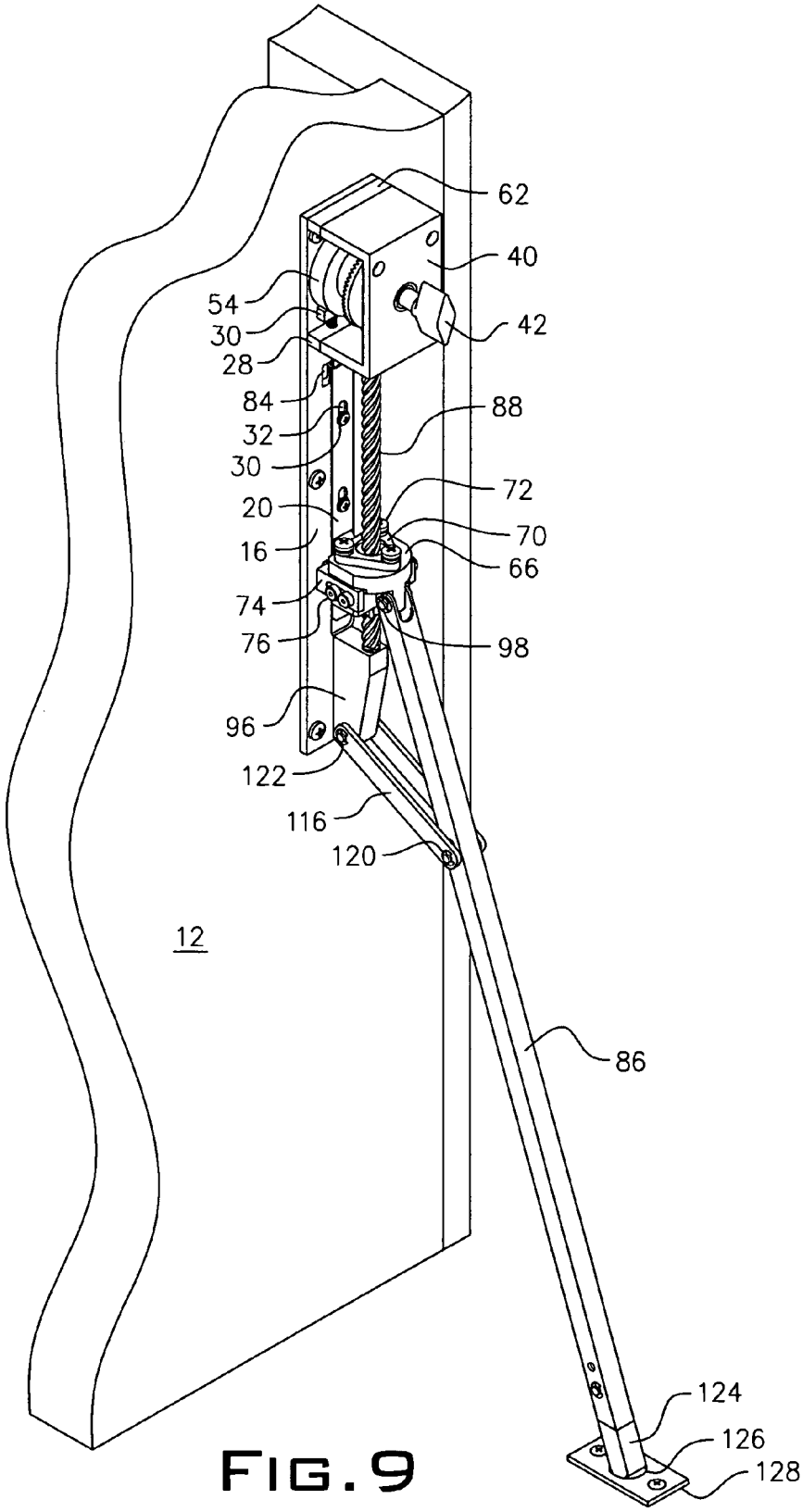
FIG. 9 is a perspective view of an alternate brace end engaged to a slot in a floor.
Figure 10:
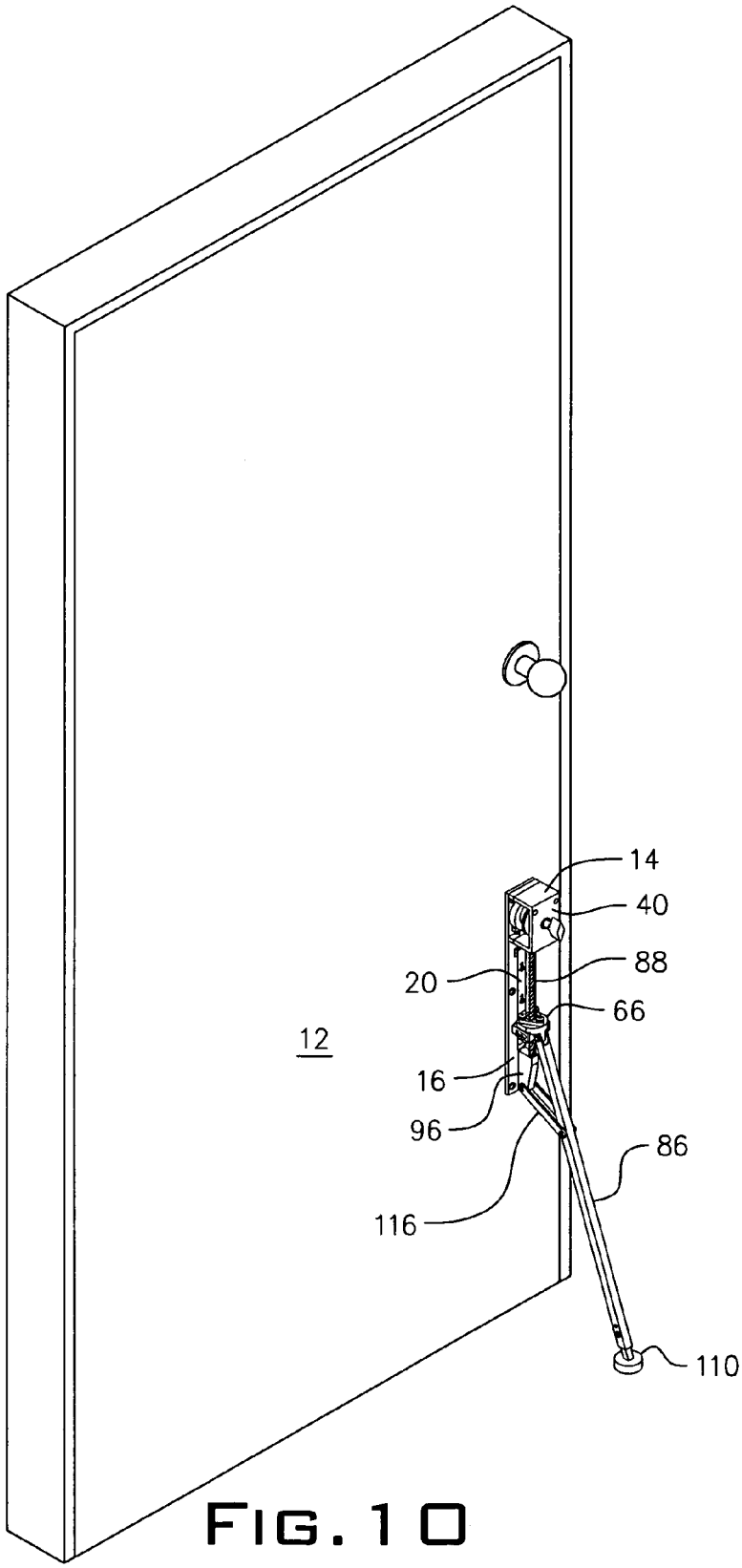
FIG. 10 is a perspective view of the door lock brace supporting a door from forced entry.
Figure 11:
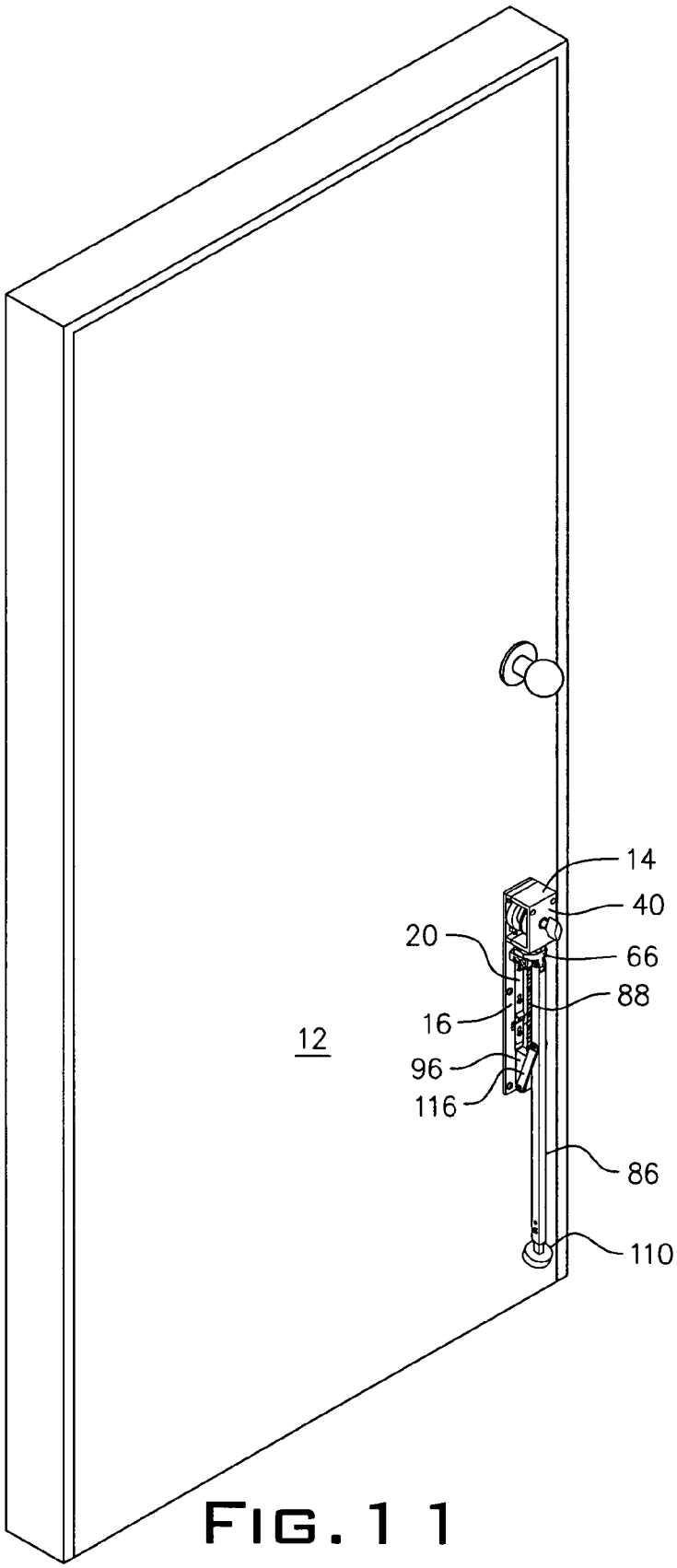
FIG. 11 is a perspective view of the door lock brace in a retracted and stored position.

In an alternate embodiment shown in FIG. 9, a lower end 124 of brace 86 fits into a hole 126 in floor plate 128 to prevent movement of brace 86 when the door lock brace is in the deployed mode.

Most of the components in the door lock brace are made of aluminum. The brace 86 can be made of high strength aluminum or steel.

Figure 8:
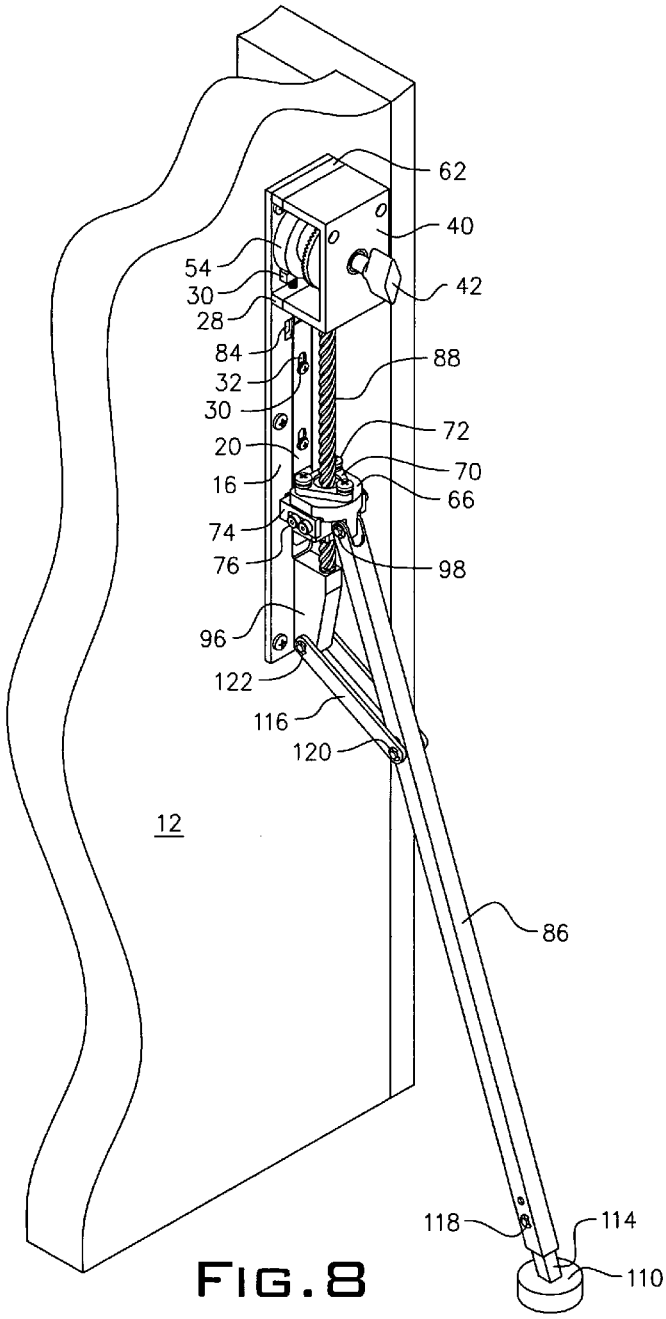
FIG. 8 is a perspective view of the door lock brace in a deployed stage.

In operation, either a key in lock 58 or the turning counterclockwise of handle 42 causes cam 54 to depress cam follower 30 which depresses springs 24. This causes slide bar 20 to move downwardly and disengaging feet 80 from slots 84. The turning of gear 46 turns gear 92 seated on key 90 of threaded rod 88. This causes rod 88 to turn in lower housing 96 and carry housing 66 downwardly. As housing 66 moves downwardly the brace leg 86 and side hinges 116 deploy outwardly until feet 80 engage lower holes 82. At this point the door lock brace is fully deployed as seen in FIGS. 8 and 9. To withdraw the leg brace, the handle 42 is turned clockwise. This again puts pressure on cam follower 30 and causes the feet 80 to be withdrawn from holes 82. The middle housing 66 moves upwardly until feet 80 are locked in holes 84 and prevented from moving further upwardly by stop 38.

Equivalent elements can be substituted for one or more elements of the subject invention to provide substantially the same results in substantially the same way.

Having described the invention what is claimed for letters Patent follows:

1. A slidable door lock brace apparatus mounted on an inside surface of a door, the apparatus comprising:

a vertically mounted fixed plate attached to the inside surface of the door, the fixed plate having a groove about midway between a first and second side edge and below a top edge and above a bottom edge with an aperture at a lower portion of the plate and an upper portion of the plate on each side of the groove;

a slide bar vertically mounted for movement within the groove;

an upper gear housing attached to an upper portion of the fixed plate above the upper apertures;

the upper gear housing containing a cam having a central axial bore, the cam rotating on a shaft turned by a lock key or a handle, the cam activating a spring to move the slide bar, the key axially turning a first gear to turn a second gear mounted on a top end of a vertically positioned threaded rod;

a middle housing attached to the threaded rod so that turning of the threaded rod by the second gear causes the middle housing to move downwardly or upwardly;

the middle housing having a lock clamp attached on an outer surface, the lock clamp having a pair of feet extending away from the middle housing to engage the apertures at either the upper or lower portion of the fixed plate and adapted to be disengaged from the apertures when the springs are activated by the cam;

a bottom end of the threaded rod mounted on a top portion of a lower housing attached to the fixed plate at a lower portion-below the groove;

a brace rod attached at a top end to the middle housing and contacting a floor surface at a second end in a deployed mode; and a pair of side hinges attached at a first end to the lower housing and at a second end to the brace rod.

2. The slidable door lock brace apparatus according to claim 1 wherein a stop is mounted at an upper and lower portion of the slide bar.

3. The slidable door lock brace apparatus according to claim 1 wherein the slide bar has multiple spaced apart apertures, each aperture containing a set screw.

4. The slidable door lock brace apparatus according to claim 3 wherein there are four apertures on the slide bar.

5. The slidable door lock brace apparatus according to claim 1 wherein the gear ratio between the first gear and the threaded rod is 4:1.

6. The slidable door lock brace apparatus according to claim 1 wherein the second end of the brace rod is attached to a pad which contacts the floor surface.

7. The slidable door lock brace apparatus according to claim 1 wherein the second end of the brace rod engages a hole in the floor surface.

8. A slidable door lock brace apparatus mounted on an inside surface of a door, the apparatus comprising:

a plate permanently affixed to the inside surface of the door, the plate having top, bottom and side edges, the side edges being longer than the top and bottom edges, the plate having a central vertical slot about midway between the side edges and ending below the top edge and above the bottom edge;

a slide bar having multiple spaced apart holes in a vertical direction, the slide bar attached to the plate within the vertical slot by a fastener through each hole in the slide bar, the slide bar adapted to move vertically;

an opening in the plate on each side of an upper portion of the slide bar and an opening in the plate on each side of a lower portion of the slide bar;

an upper gear housing attached to an upper portion of the plate, the upper gear housing enclosing a cam having a central axial bore, the cam rotating on a shaft turned by a lock key or a handle, the cam activating a spring to move the slide bar, the shaft further turning a first gear axially mounted with respect to the central axial bore, the first gear turning a second gear mounted on a top end of a vertically positioned threaded rod, a bottom end of the threaded rod mounted in a bottom housing attached to a lower portion of the plate;

a middle housing threadably attached to the threaded rod and adapted to move upwardly or downwardly depending on the direction in which the key shaft is turned; and a brace rod attached at a top end to the middle housing and contacting a floor surface at a second end in a deployed mode.

9. The slidable door lock brace apparatus according to claim 8 wherein the middle housing has a U-shaped lock clamp attached to an outer surface, the clamp having a pair of feet depending away from the middle housing and engaging the openings in the plate on each side of the slide bar.

10. The slidable door lock brace apparatus according to claim 8 wherein the brace rod is attached to a first end of a pair of side hinges, the bottom housing attached to a second end of the pair of side hinges.

11. The slidable door lock brace apparatus according to claim 8 wherein the middle housing has a central vertical bore containing a threaded lug, the lug threaded to the threaded rod.

12. The slidable door lock brace apparatus according to claim 8 wherein a stop is mounted on the slide bar between each pair of openings in the plate.

13. The slidable door lock brace apparatus according to claim 8 wherein the gear ratio between the first gear and the threaded rod is about 4:1.

14. The slidable door lock brace apparatus according to claim 8 wherein counterclockwise movement of a key deploys the brace and a clockwise movement of the key retracts the brace to a position abutting the inside surface of the door.

15. The slidable door lock brace apparatus according to claim 8 wherein the slide bar is attached to the plate by screws threaded to receptacles on the plate.

* * * * *